US009179804B2

(12) United States Patent
May

(10) Patent No.: US 9,179,804 B2
(45) Date of Patent: Nov. 10, 2015

(54) SINK TOWEL

(76) Inventor: Gwendolyn May, Woodbridge, VA (US)

( * ) Notice: Subject to any disclaimer, the term of this patent is extended or adjusted under 35 U.S.C. 154(b) by 665 days.

(21) Appl. No.: 13/555,081

(22) Filed: Jul. 20, 2012

(65) Prior Publication Data

US 2013/0019397 A1 Jan. 24, 2013

Related U.S. Application Data

(60) Provisional application No. 61/510,693, filed on Jul. 22, 2011.

(51) Int. Cl.
*A47J 47/20* (2006.01)

(52) U.S. Cl.
CPC ..... *A47J 47/20* (2013.01)

(58) Field of Classification Search
CPC ..... E03C 1/181
USPC ..... 4/655, 657, 658
See application file for complete search history.

(56) References Cited

U.S. PATENT DOCUMENTS 6,223,362 B1 * 5/2001 Liang ..... 4/655
2006/0059619 A1 * 3/2006 Kim et al. ..... 4/655

* cited by examiner

*Primary Examiner* — Huyen Le
(74) *Attorney, Agent, or Firm* — William H. Holt

(57) ABSTRACT

A sink towel for being disposed about a bathroom, restroom or washroom sink bowl for absorbing water that may be inadvertently or accidently splashed with water upon a surrounding counter top. The towel is comprised of natural or synthetic, water absorbent material which may include paper, cloth or fabric, and is preferably formed of cotton or terry cloth. One or more pockets are included for storing personal items such as tooth brushes, toothpaste, razors, and/or small containers of medicine, shampoo, perfume, or similar items. The towel includes weights or weighted material for holding the towel in place over the sink bowl and also permit the towel to be folded for travel and for hanging on a hook for storage and/or drying between uses.

11 Claims, 4 Drawing Sheets

SINK TOWEL

FIELD OF THE INVENTION

The present invention relates to a sink towel, and more particularly to a special purpose towel used to both absorb liquids used over and in the vicinity of a sink bowl as well as to protect the counter top surrounding the immediate sink area.

BACKGROUND OF THE INVENTION

As known in the art, most present day household bathrooms, restrooms, or washrooms, include a sink bowl that is recessed into a counter top and is used primarily for washing a person's hands and face, or brushing the person's teeth, or laundering small items such as scarves, socks or stockings, etc. The recessed sink bowl may be integrally formed with the counter top as a single unit or mounted as a separate piece within a counter top opening. The sink bowl may also comprise a standalone unit knows as a pedestal sink and having a framed region or counter top surface around the howl.

The uses described above may result in the counter top becoming splashed with water, either plain or soapy. It is also quite common for the user to get their clothes slightly splashed, or wet from coming into contact with the counter top.

In addition to the descriptions above using water, the counter top may also be permanently stained or discolored from splashes resulting From the use of hair dye, nail polish, and other commonly applied beauty products used in the immediate sink bowl area of present invention.

A towel comprised of one or more layers of fabricated material, such as terry cloth towel fabric having a generally rectangular shape, with a U-shape opening in the top middle is provided with a form of or type of weight, such as a string of small weights sewn or otherwise secured to and placed around the margin of the opening thereby weighting the towel to the counter top over the sink bowl to keep the towel from sliding and thereby holding it in place. A string of substantial weight or a string weight may also be used.

The towel absorbs water off of the counter, and absorbs splashes so that in most cases one does not get their clothes wet as they lean over the sink bowl. The towel also aids in helping to keep the area around the sink clean, as well as cushioning the lower arm and elbows as one sometimes leans onto the counter top. Anyone with a bathroom sink and counter top can use this item. The towel is placed flat on the bathroom counter top with the U-shaped opening around the perimeter of the sink bowl and is large enough so that a few inches of the towel hangs over the front edge of the counter top.

The towel absorbs water off of the counter; aids in helping to keep the area around the sink clean, free of standing water, cushions the lower arms and elbows of the user and, preferably, is decorative and adds color and beauty to the usually staid sink and counter top.

A further object of the invention is the provision of one or more pockets for storing personal items such as a razor, or toothbrush, a tube of toothpaste, a small bottle of pills, such as aspirin or antacid, nail clipper or file, and the like. Thus, the towel may then be rolled or folded and placed in a suitcase or travel bag thereby making for a convenient. private and personal item for use in, for example, hotels, motels and other travel accommodations.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF THE INVENTION

Figure 1:
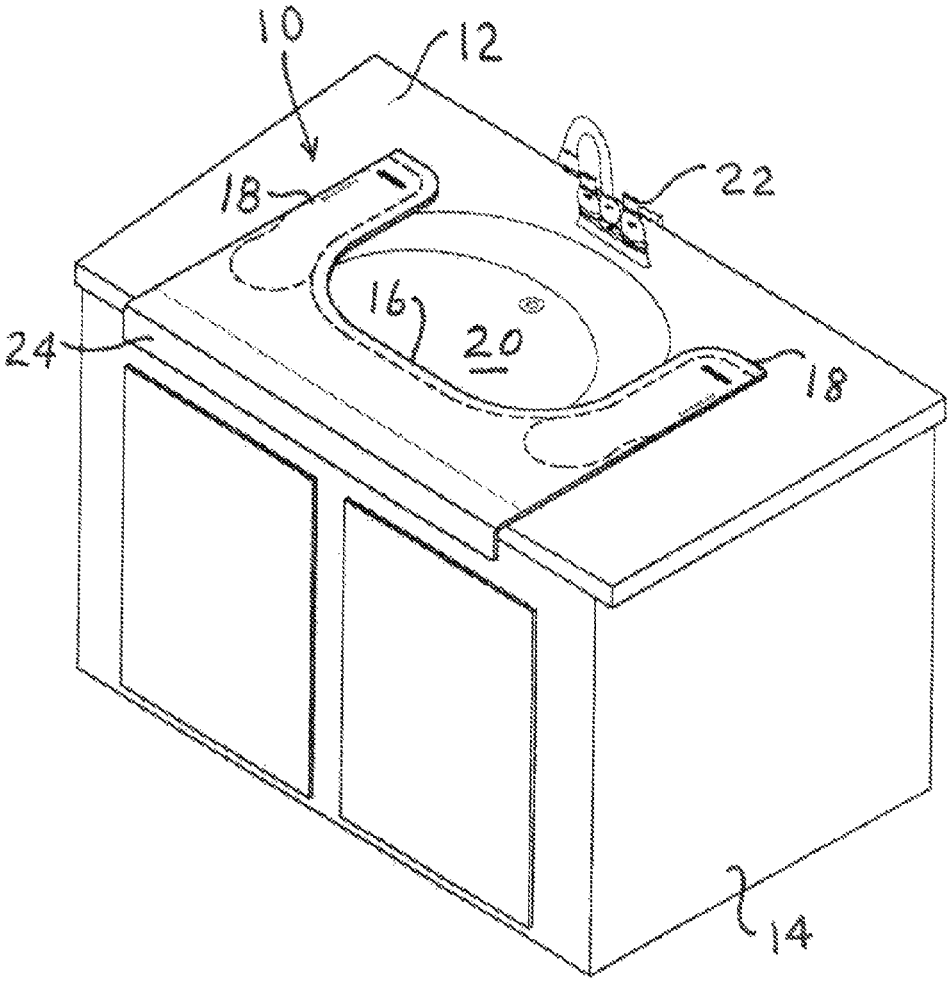
FIG. 1 is a perspective view of a typical sink bowl that is recessed into a counter top and shows a sink towel in accord with the present invention located about the sink bowl and having a small overhang at the front of the counter top.

FIG. 1 illustrates a sink towel, generally indicated by the numeral 10, placed upon the upper surface or counter top 12 of a typical counter 14, the sink towel 10 having a U-shaped opening formed by a bight portion 16 and extending legs 18 disposed in close proximity about a conventional sink 20 and water faucets 22. Towel 10 is comprised of a water absorbent fabric 11, preferably cotton or terry cloth, and includes a skirt portion 24 shown in FIG. 1 as depending down the front of counter top 12 for providing an absorbent surface for protecting a user's clothing from inadvertently getting wet..

Figure 2:
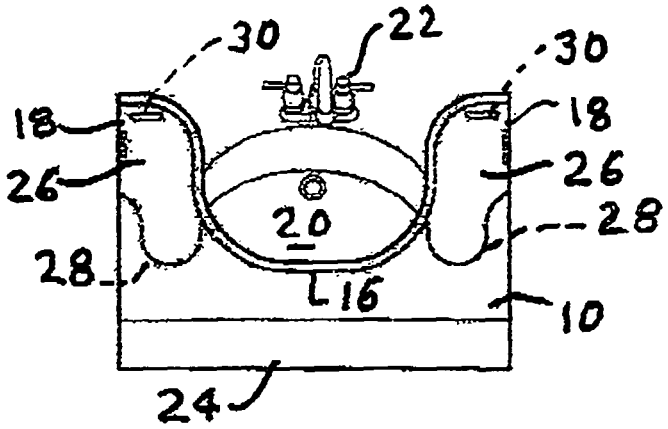
FIG. 2 illustrates the sink towel located about a typical sink bowl, without showing the surrounding counter and counter top.
Figure 3:
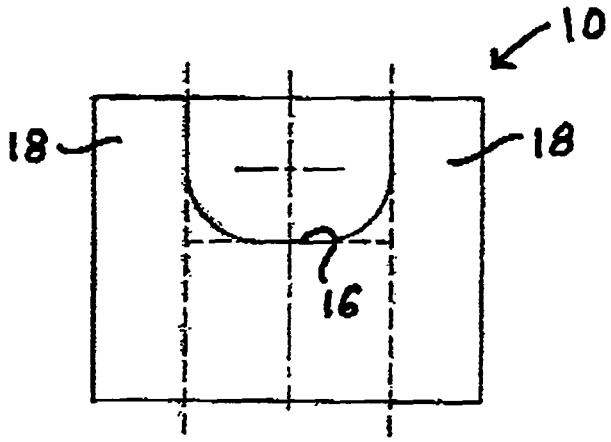
FIG. 3 is a fragmentary view showing construction lines useful in the steps of cutting and manufacturing the sink towel.

FIG. 2 illustrates a feature of the invention wherein the legs 18 each incorporate a pocket 26 on the underside thereof for providing a storage space for personal items such as a razor, toothbrush, tube of toothpaste, medicine container, and the like. The pockets 26 are illustrated by the broken line 28 which may comprise threaded seams for attaching a second layer of material to the underside of the sink towel 10. Hook and loop fasteners 30 are provided for closing the open ends of the pockets 26.

Figure 4A:
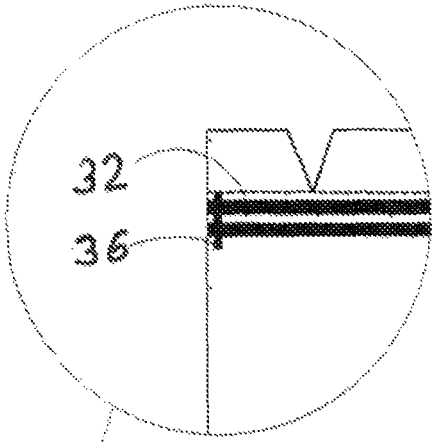
FIG. 4A is an enlarged showing of a portion of FIG. 4 showing details of securing weights to the sink towel.
Figure 4:
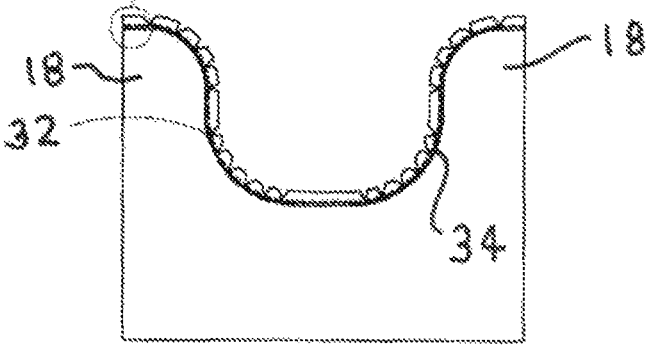
FIG. 4 illustrates one form of the invention showing a string of small weights attached to the U-shaped portion of the towel that conforms to a portion of the sink bowl.

FIGS. 4 and 4A illustrate a feature of the invention wherein a string of small weights 32 are attached to the U-shaped opening defined by the legs 18 and bight portion 16 along a stitched seam 34. The weights may be secured as shown in FIG. 4A, with staples or clamps 36. The purpose of weights 32 is to hold the sink towel 10 in place upon the counter top 12 so that the towel 12 does not slide onto the floor or into the sink 20.

Figure 5:
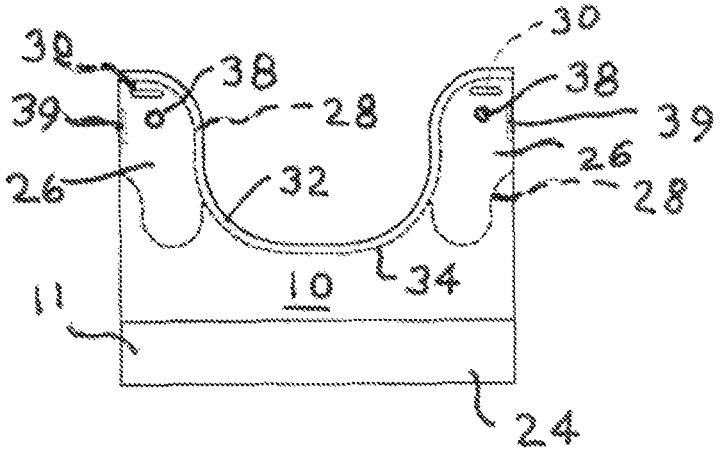
FIG. 5 is a plan view of the sink towel and shows the outline of a pair of pockets formed therein and also shows a pair of openings that provides a means for hanging the sink towel upon a hook for storage or drying.

FIG. 5 is a plan view of a sink towel 10 and illustrates the U-shaped opening defined by the bight portion 16, legs 18 and skirt portion 24 hanging over a forward area of the counter top. Also shown is a pair of slots or bottom holes 38 which provide for hanging the sink towel 10 On a hook or post (not shown) for storing or hanging the sink towel 10 to dry between uses.

Figure 6:
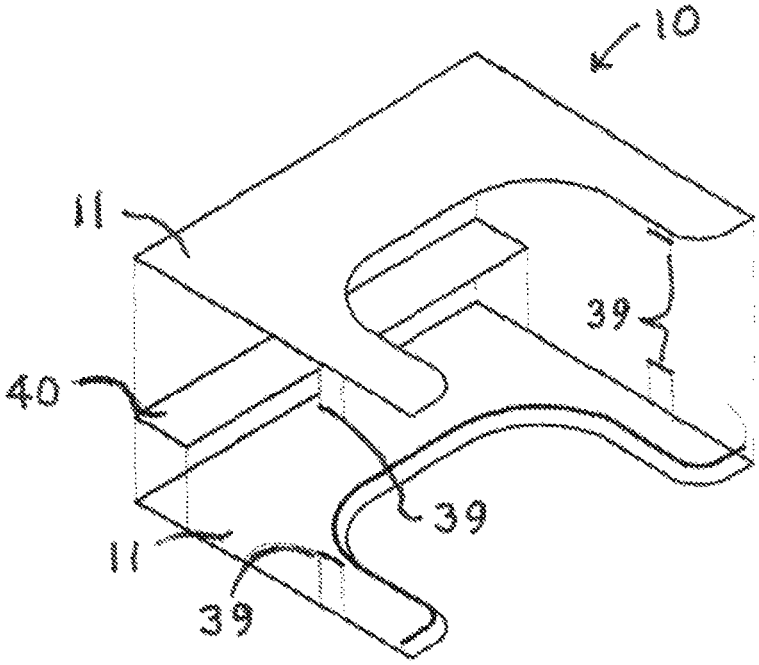
FIG. 6 is an exploded view for illustrating elements of the invention.

FIG. 6 is an exploded view showing the various parts which make up the sink towel 10. As shown there are a plurality of hook and loop fasteners 39 for securely connecting the upper and lower layers of materials. Also shown is the provision of an additional piece of material 40 which provides a cushion for a user's arms or wrist.

While the present invention has been described and illustrated in detail. Various modifications may be made by those skilled in the art. It is therefor to be understood that the invention is not to be limited to the details of construction described and illustrated and it is intended by the claims to cover all modifications which fall within the spirit and scope of the claimed invention.

What is claimed is:

1. A sink towel comprised of water absorbent material and designed for placement upon a counter top for at least partially surrounding a sink or wash basin, said water absorbent material comprising means for absorbing water that may be splashed upon the counter top during use of the sink, said sink towel including a U-shaped opening formed along one side thereof, and weighted means for holding said sink towel upon the counter top, wherein said weighted means comprises a string of weights secured to said towel along the bight and leg portions of said U-shaped opening.

2. The sink towel as defined in claim 1 wherein said towel is comprised of a plurality of layers of material, and at least one-pocket being formed between said layers for providing a storage space.

3. The sink towel as defined in claim 2 wherein said water absorbent material is comprised of a water absorbent fabric.

4. The sink towel as defined in claim 3 wherein said fabric is terry cloth.

5. The sink towel as defined in claim 1 including slot means for providing means for hanging said sink towel for drying and storage.

6. A sink towel comprising at least one layer of water absorbent material and having an area and a thickness, said towel lying flat on a counter top and having a patterned opening within said area for placement upon said counter top and at least partially covering and surrounding a sink or wash basin, said towel comprising means for absorbing fluids splashed around said sink, said counter top having an edge, and said sink towel defining a forward area which hangs over said counter top edge, said patterned opening being U-shaped and formed behind the forward area and defining the patterned partial covering surrounding said sink or wash basin, and weighted means secured along said U-shaped opening for holding said sink towel in place upon the counter top, wherein said weighted means comprises a string weight secured to said towel along said U-shaped opening partially covering and surrounding said sink or wash basin.

7. The sink towel as defined in claim 6 wherein said towel is comprised of a plurality of layers of material, and at least one pocket being formed between said layers for providing a storage space.

8. The sink towel as defined in claim 6 including slot means for providing means for hanging said sink towel for drying and storage.

9. The sink towel as defined in claim 6 wherein said weighted means along said U-shaped opening pulls said towel slightly downward over said sink bowl.

10. A sink towel comprising at least one layer of water absorbent material and having an area and a thickness, said towel lying flat on a counter top and having a patterned opening within said area for placement upon said counter top and at least partially covering and surrounding a sink or wash basin, said towel comprising means for absorbing fluids splashed around said sink, said counter top having an edge, said patterned opening being U-shaped and formed behind the forward area and defining the patterned partial covering surrounding said sink or wash basin, wherein said towel is comprised of a plurality of layers of material, and at least one pocket being formed between said layers for providing a storage space.

11. The sink towel as defined in claim 10 including hook and loop fasteners for closing said at least one pocket.

* * * * *